United States Patent [19]

Houston

[11] Patent Number: 4,552,305

[45] Date of Patent: Nov. 12, 1985

[54] FURNACE

[76] Inventor: Reagan Houston, 252 Foxhunt Dr., Long John Mountain, Hendersonville, N.C. 28739

[21] Appl. No.: 717,941

[22] Filed: Mar. 25, 1985

[51] Int. Cl.[4] ..... F24D 5/10; F23G 5/02; F22B 1/02

[52] U.S. Cl. ..... 237/69; 110/245; 110/215; 126/110 R; 237/19

[58] Field of Search ..... 122/4 D; 110/245, 215; 237/19, 69; 126/110 R

[56] References Cited

U.S. PATENT DOCUMENTS

| | | | |
|---|---|---|---|
| 3,366,080 | 1/1968 | Albertson | 110/245 |
| 3,525,309 | 8/1970 | Katz | 110/215 |
| 4,273,073 | 6/1981 | Robinson | 110/245 |
| 4,325,327 | 4/1982 | Kantesaria et al. | 110/245 |
| 4,355,601 | 10/1982 | Hattiangadi | 110/245 |
| 4,398,477 | 8/1983 | Iwasaki | 110/245 |
| 4,416,418 | 11/1983 | Goodstine et al. | 110/245 |
| 4,436,057 | 3/1984 | Cross et al. | 110/215 |
| 4,465,022 | 8/1984 | Virr | 122/4 D |
| 4,474,122 | 10/1984 | Hokari et al. | 110/245 |
| 4,515,093 | 5/1985 | Beardmore et al. | 110/215 |

*Primary Examiner*—Henry C. Yuen
*Attorney, Agent, or Firm*—Leslie H. Blair

[57] ABSTRACT

A furnace for burning sawdust wherein combustion of the fuel is complete and recovery of heat of combustion is high, which incorporates an aspirator for controlling combustion of the fuel and for secondarily recovering heat from the products of combustion, and additionally for cleaning the exhaust gases. The invention incorporates primary and secondary heat exchange chambers.

6 Claims, 1 Drawing Figure

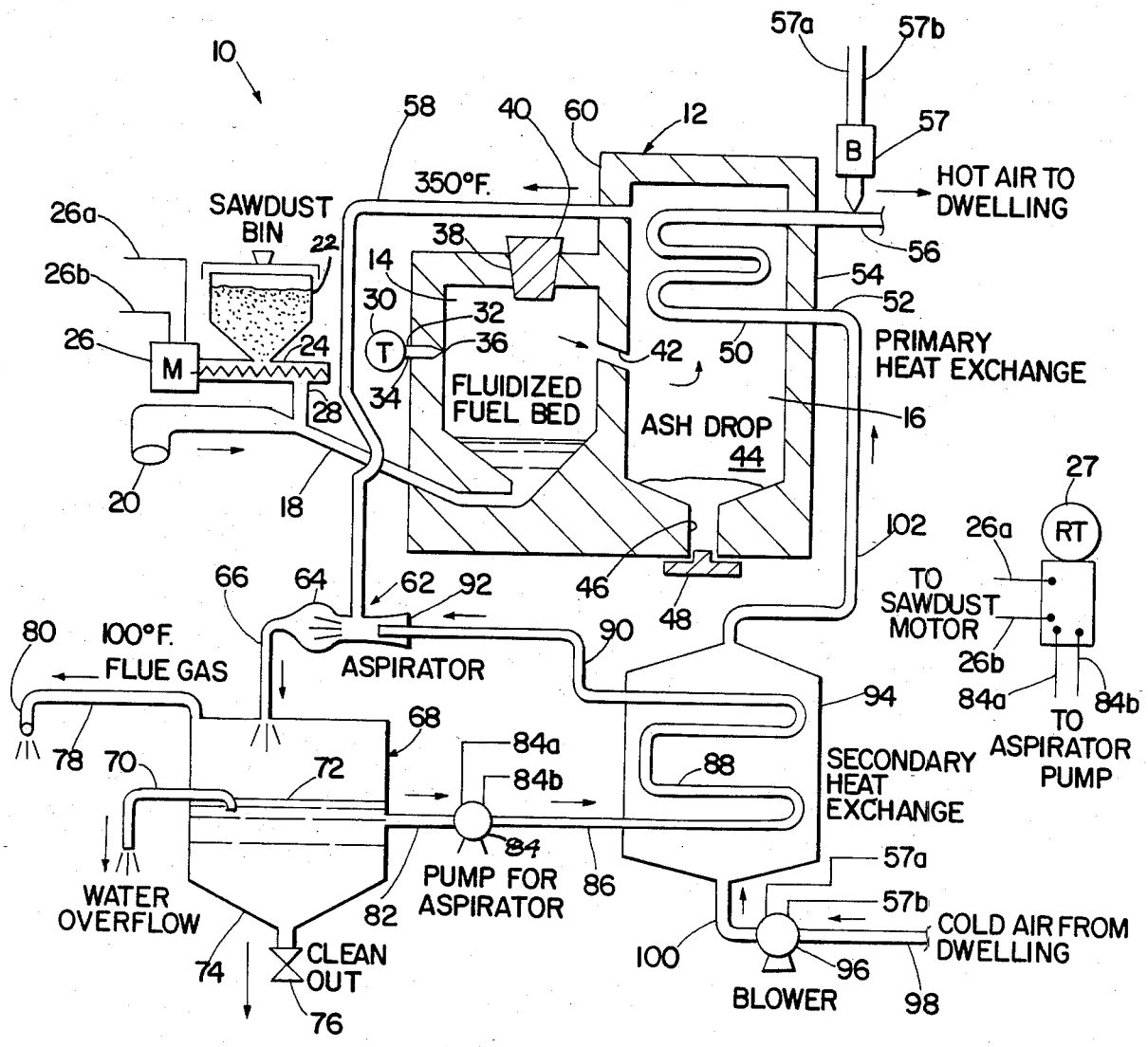
10
57a
57b
58
40
60
12
57
B
350°F.
HOT AIR TO DWELLING
26a
SAWDUST BIN
22
38
56
26b
14
54
30
32
52
26
M
24
T
36
42
50
PRIMARY HEAT EXCHANGE
34
FLUIDIZED FUEL BED
28
ASH DROP
44
16
20
18
27
RT
102
26a
66
64
62
92
46
TO SAWDUST MOTOR
80
100°F.
FLUE GAS
ASPIRATOR
90
48
26b
94
84a
84b
68
TO ASPIRATOR PUMP
78
70
72
84a
84b
88
SECONDARY HEAT EXCHANGE
84
57a
WATER OVERFLOW
PUMP FOR ASPIRATOR
86
57b
82
COLD AIR FROM DWELLING
74
CLEAN OUT
100
96
BLOWER
98
76

FURNACE

This invention relates to a furnace for burning sawdust to heat domestic dwellings such as homes and the like. More particularly the invention relates to a sawdust burning furnace that produces high combustion efficiency, high heat recovery and clean exhaust.

It is known in the art to burn sawdust in stoves and furnaces of conventional grate-type construction. However, stoves and furnaces designed for solid fuels such as coal and wood do not efficiently burn sawdust due to the caking nature of the material. Combustion is very poor, being confined to the outer surface of a pile or cake of burning sawdust. Much manual probing and poking of the fire bed is required for sufficient air to mix with the burning sawdust to provide combustion. At best, erratic heat and incomplete combustion result from trying to burn sawdust in known furnaces and stoves.

It is therefore an object of the invention to provide a novel furnace for burning sawdust for heating domestic dwellings.

A further object is to provide a novel sawdust burning furnace wherein combustion of the fuel is complete and heat recovery is high.

A further object is to provide a novel furnace utilizing a water powered aspirator for controlling combustion of the fuel and for recovering heat from the products of combustion, and additionally for cleaning the exhaust gases.

These and other objects will be evident from the following description and claims.

The invention is illustrated in the accompanying drawing, wherein

The FIGURE is a schematic view of the furnace of the invention.

Like parts are indicated by like characters throughout the specification and drawings.

As shown in the drawing, the furnace 10 includes a refractory housing 12 that is divided into two chambers. The first is the combustion chamber 14 and the second is the primary heat exchange chamber 16.

Connected to the combustion chamber 14 is an inlet pipe 18 having an intake opening 20 whereby atmospheric air can flow freely into the combustion chamber. A sawdust bin 22 has a screw feeder 24 connected at the bottom and is driven by a motor 26. Motor 26 is connected by electrically conductive lines 26*a*, 26*b* to a room thermostat controller 27. Screw feeder 24 is connected to sawdust inlet pipe 28. Sawdust is fed into inlet pipe 28 and admixed with incoming air for movement through pipe 18 into the bottom of the combustion chamber 14.

A thermocouple control 30 is connected by lead wires 32, 34 to a junction 36, exposed to the interior of the combustion chamber 14. Thermocouple control 30 acts as ignition detector as explained below.

Access port 38 and removable plug 40, of suitable heat-resistant material, permit ignitable materials to be dropped into the combustion chamber 14 for start up.

A transfer port 42 connects the combustion chamber 14 and the primary heat exchange chamber 16. The transfer port 42 is small in area compared to the combustion chamber 14.

The bottom of the primary heat exchange chamber 16 is of conical shape, providing an ash drop zone identified by the reference numeral 44. A swirling motion is imparted to the combustion products flowing out of transfer port 42 and into the primary heat exchange chamber 16. This swirling motion causes drop out of particulate fly ash in the ash drop zone 44.

A clean out port 46 is provided in the bottom of primary heat exchange chamber 16 for removing ash accumulation. Cover plate 48 closes the clean out port 46 and is kept in place by suitable retainer means, not shown, during operation of the furnace 10.

A primary heat exchange coil 50 is positioned in the upper part of primary heat exchange chamber 16. An inlet pipe 52 extends through the wall 54 of refractory housing 12 and an outlet pipe 56 also extends through the wall 54. These provide for moving heat exchange fluid such as air through primary heat exchange coil 50 and into the dwelling.

A bonnet thermostat controller 57 is connected in temperature-sensing relation to outlet pipe 56. Electrically conductive lines 57*a*, 57*b* connect to an air circulating fan 96, for controlling the fan, as described below.

At the top of the primary heat exchange chamber 16 is an outlet pipe 58, extending through wall 60 of refractory housing 12. Outlet pipe 58 is connected to the suction side of an aspirator 62. The outlet 64 of aspirator 62 is connected by pipe 66 to a water collection tank 68. The water collection tank 68 has an overflow pipe 70 to control water level 72. Collection tank 68 has a conical bottom 74 and a valve 76 for clean out. This provides for particulate sludge removal from the aspirator water.

Flue pipe 78 extends from the top of water collection chamber 68, above the water line 72. Flue pipe 78 leads to atmosphere. An exhaust opening 80 is provided, inverted for protection against atmospheric fall out such as rain, snow etc.

Below water line 72 is a pipe 82, extending to the inlet of pump 84. Pump 84 is connected by electrically conductive lines 84*a*, 84*b* to room thermostat controller 27, previously mentioned, that also automatically controls sawdust feeder motor 26. Pump 84 has an outlet pipe 86 extending to secondary heat exchange coil 88 and the secondary heat exchange coil has an outlet pipe 90, connected to the jet side 92 of aspirator 62.

Secondary heat exchange coil 88 is positioned in housing 94. A blower 96 is connected by electrically conductive lines 57*a*, 57*b* to bonnet thermostat controller 57, located at the outlet 56 of primary heat exchange coil 50.

Blower 96 has an inlet pipe 98, coming from the dwelling, not shown. Outlet pipe 100 is connected to the bottom of housing 94. A pipe 102 extends from the top of housing 94 to inlet 52 of primary heat exchange coil 50.

OPERATION OF THE INVENTION

For start up of fire 10, a ball of ignited paper, and kindling are inserted through access port 38 into the bottom of combustion chamber 14. Aspirator water pump 84 is started by manual override, not shown. This causes air to flow into the bottom of the combustion chamber 14 through inlet opening 20 and inlet pipe 18, by reduction of pressure in the combustion chamber, port 42, primary heat exchange chamber 16 and pipe 58 leading to aspirator 62. When the start up fire reaches sufficient temperature to provide ignition detection by thermocouple control 30, then motor 26 of sawdust feeder 24 is actuated by automatic or manual means, not shown.

A fluidized and/or swirling bed of burning sawdust is generated in the bottom of the combustion chamber 14. This elevates the temperature of the refractory 12 in that area and retains a smouldering bed of sawdust for reignition on call.

Alternatively, if the wood particles are small in relation to the gas velocities in the combustion chamber, then all of the solid particles may be fluidized or entrained in the gas.

After manual start, the sawdust feed motor 26 and aspirator pump 84 are switched to automatic control by room thermostat 27. When room thermostat 27 reaches set temperature, circuits to the aspirator pump 84 through lines 84*a*, 84*b*; and to screw feeder motor 26 by lines 26*a*, 26*b* are opened. Combustion cycles back to threshhold ignition level. Thermocouple control 30, with junction 36 in combustion chamber 14, continues to function as ignition detector and intermittently runs the combustion process in short spurts to retain reignition temperature level. This keeps the fire bed and refractory hot enough to cycle on call from room thermostat 27. Absent reignition conditions, such as insufficient combustion chamber temperature, thermocouple control 30 will stop the furnace 10, such as in case of either fuel or air failure or both.

Transfer port 42 is much smaller of cross sectional area than the combustion chamber 14 so that the combustion chamber is as hot as possible while the fuel is burning. With a slight excess of air, all fuel particles, charcoal, creosote, tar, carbon monoxide and other combustibles will be fully burned. Also, when heat is not required from the furnace, the combustion chamber will cool only very slowly, as only a small amount of heat flows through the small transfer port 42 and into the primary heat exchange chamber 16.

The fluidized combustion bed in the bottom of combustion chamber 14 produces complete combustion of the sawdust particles. The fuel particles remain in the combustion chamber 14 until completely reduced to a light weight ash. The combustion products thus consist of gases and fly ash; these pass through port 42 into the cyclonic lower ash drop zone 44 of primary heat exchange chamber 16.

The air inlet to the combustion chamber 14 can be designed to produce a swirl or cyclonic action in the combustion chamber. Also, if desired, air can be admitted to more than one place into the combustion chamber.

Ash drop takes place before primary heat exchange. After ash drop, the gases flow around primary heat exchange coil 50. This keeps the primary heat exchange coil 50 clean and maintains high heat recovery efficiency.

Aspirator 62 continues to reduce pressure in pipe 58, and the gases of combustion from the primary heat exchange chamber 16 move to the aspirator. In the aspirator 62, the combustion gases are intermingled with the aspirator water and are carried with the water to water collection chamber 68. This action recovers most of the residual heat, not extracted by the primary heat exchange coil 50. Any moisture in the sawdust fed into the combustion chamber 14 is converted to steam by the combustion process. Steam content in the combustion gases is condensed to water by the water flowing through aspirator 62, and thus, heat of vaporization is recovered. Also, most fly ash in the gases moving through line 58 is entrapped in the aspirator water and settles to the bottom of the water collection chamber 68. Flue gases at about 100°-150° F. move out of the system through flue 78, 80.

Water overflow pipe 70 maintains water level 72 constant as water from the combustion products is added to the aspirator water.

The heated aspirator water is moved by pump 84 through pipes 82, 86 through secondary heat exchange coil 88. The secondary heat exchange coil 88 preheats the return air from the dwelling, substantially boosting heat recovery efficiency of the system. Preheated dwelling return air moves out of secondary heat exchange coil 88 to primary heat exchange coil 50 through pipe 102. In primary heat exchange coil 50, the air temperature is boosted to a level suitable to heat the dwelling.

The prior description has referred to the use of refractory for the furnace 10, the combustion chamber 14, transfer port 42, primary heat exchange chamber 16, etc. The invention encompasses the use of heat resistant materials such as metal, refractory-lined metal and the like for the parts of the furnace exposed to direct combustion and combustion products which are at highest temperatures.

The prior description has referred to the movement of air from the dwelling, through the secondary heat exchange coil 88 and the primary heat exchange coil 50. The invention encompasses the movement of a heat transfer liquid such as water. Pump 96, coil 88, coil 50 and connecting pipes could be engineered for handling liquids for radiators or fin tube heaters as for baseboard heating. Therefore the invention would include the movement of a fluid, either gas or liquid, through the heat exchange portions of the furnace.

The specification has illustrated return air from the dwelling entering the secondary heat exchange coil 90, and then flowing to the primary heat exchange coil 50 by series flow.

However, the invention encompasses at least one heat exchange coil in the primary heat exchange chamber and at least one heat exchange coil in the secondary heat exchange chamber. These heat exchange coils can operate cooperatively, or separately and independently.

As an example, the primary heat exchange coil could heat air for the dwelling. The secondary heat exchange coil could heat water for domestic use.

Still further, the primary heat exchange chamber could contain two heat exchange coils, i.e., a first for heating air for the dwelling: and a second for heating domestic hot water. Then, the secondary heat exchange coil could recover heat for still another purpose.

Thus, the invention encompasses at least one heat exchange coil in the primary heat exchange chamber and at least one heat exchange coil in a secondary heat exchange chamber- these coils operating cooperatively or independently.

From the foregoing it will be evident that important features of the invention include the following:

When the furnace is operating at design temperatures,

1. Air and sawdust are supplied in correct ratio (slight excess of air) for complete combustion. The aspirator and sawdust feeder in combination provide constant flow of combustion air and constant feed of sawdust fuel.

2. Time, temperature and space for complete combustion are provided in the combustion chamber 14. The fully burned fuel is converted completely to gases and a light weight ash. The gases and ash, as fly ash, move from the combustion chamber 14 through port 42 to the ash drop zone 44 of the primary heat exchange chamber 16. This keeps the combustion chamber 14 clean and thus combustion is never impaired by ash buildup.

3. The separation of ash in ash drop zone 44 in the lower part of primary heat exchange chamber 16 permits substantially clean combustion gases to flow around primary heat exchange coil 50 thereby keeping it clean of ash buildup and maintaining heat recovery at a high level.

4. Aspirator 62 provides a safety feature. If aspirator water stops for any reason, combustion air stops and the furance shuts down.

5. The aspirator further enhances heat recovery. The aspirator water condenses the steam content of the combustion gases and recovers heat of vaporization. The aspirator water also recovers heat not recovered by primary heat exchange coil 50.

6. The water for aspirator 62 traps most residual fly ash from the exhaust gases. This provides a very clean exhaust, essentially free of smoke and the like with some water vapor. Pollution of environment is substantially eliminated.

7. Separate chambers for combustion 14 and heat exchange 16 are separated by a small transfer port 42. This keeps the combustion chamber 14 as hot as possible to give complete combustion of creosote, charcoal and other combustibles. Likewise, when there is no demand for heat in the dwelling, combustion chamber 14 cools slowly, and operation of the furnace to keep the chamber 14 hot enough for reignition is minimized.

I claim:

1. A furnace comprising, a combustion chamber and a first heat exchange chamber and a transfer port connecting said combustion chamber and said first heat exchange chamber in gas flow relationship, inlet means for fuel and combustion air into said combustion chamber, first heat exchange means in said first heat exchange chamber, an aspirator having an inlet, an outlet and a suction port, said suction port connected in gas flow relationship to said first heat exchange chamber, means for circulating fluid through said aspirator to reduce pressure in said suction port, in said first heat exchange chamber, in said transfer port and in said combustion chamber whereby combustion air flows into said combustion chamber through said combustion air inlet means, second heat exchange means connected in fluid flow relationship to said first heat exchange means, and means for circulating fluid from said outlet of said aspirator in heat exchange relationship to said second heat exchange means.

2. The invention of claim 1 wherein liquid is circulated through the aspirator to reduce pressure, and the means for circulating fluid from the outlet of the aspirator to the second heat exchange means includes a collection chamber receiving liquid and gas from the aspirator outlet, and means in the collection chamber to separate liquid and gas.

3. The invention of claim 2 wherein the means in the collection chamber to separate liquid and gas includes means for controlling liquid level in the collection chamber, and a flue for gas to exit from the collection chamber above the liquid level.

4. The invention of claim 1 wherein the heat exchange chamber has a conical bottom and the transfer port is oriented to direct products of combustion from the combustion chamber downwardly towards said conical bottom to impart a swirling motion to said products of combustion and cause a separation of particulates from gases, port means in the bottom of said heat exchange chamber for removing particulates from said heat exchange chamber, and wherein said first heat exchange means is positioned above said transfer port.

5. A furnace comprising, a combustion chamber and a separate heat exchange chamber and a transfer port connecting said combustion chamber and said heat exchange chamber in gas flow relationship, heat exchange means in said heat exchange chamber and means for circulating heat exchange fluid in heat exchange relationship with said heat exchange means, inlet means for fuel and, combustion air into said combustion chamber and means for feeding fuel and air at controlled ratio into said combustion chamber to produce combustion of fuel into gases of combustion, an aspirator having a suction port and an outlet, said suction port connected in gas flow relationship to said heat exchange chamber to receive gases of combustion from said heat exchange chamber, and means for circulating fluid through said aspirator thereby reducing pressure in said suction port to reduce pressure in said heat exchange chamber and in said transfer port and in said combustion chamber to cause combustion air to flow into said combustion chamber through said inlet for combustion air.

6. The invention of claim 5 wherein gases flowing from said heat exchange chamber flow through said aspirator, and means for recovering heat content from said gases of combustion flowing through said aspirator.

* * * * *